US009700193B2

(12) United States Patent
Burdsall et al.

(10) Patent No.: US 9,700,193 B2
(45) Date of Patent: Jul. 11, 2017

(54) TUBULAR HEAD BAND MOUNTED WET MOP

(71) Applicant: Rubbermaid Commercial Products, LLC, Winchester, VA (US)

(72) Inventors: Thomas A. Burdsall, Huntersville, NC (US); Samuel R. Macio, Charlotte, NC (US); Daniel Morgan Galleno, Huntersville, NC (US)

(73) Assignee: Rubbermaid Commerical Products, LLC, Atlanta, GA (US)

( * ) Notice: Subject to any disclaimer, the term of this patent is extended or adjusted under 35 U.S.C. 154(b) by 260 days.

(21) Appl. No.: 14/688,023

(22) Filed: Apr. 16, 2015

(65) Prior Publication Data

US 2016/0106293 A1 Apr. 21, 2016

Related U.S. Application Data

(60) Provisional application No. 62/065,975, filed on Oct. 20, 2014.

(51) Int. Cl.

| | |
|---|---|
| ***A47L 13/20*** | (2006.01) |
| ***A47L 13/24*** | (2006.01) |
| ***A47L 13/252*** | (2006.01) |

(52) U.S. Cl.

CPC ..... *A47L 13/24* (2013.01); *A47L 13/20* (2013.01); *A47L 13/252* (2013.01)

(58) Field of Classification Search

USPC ..... 15/228, 229.1–229.9

See application file for complete search history.

(56) References Cited

U.S. PATENT DOCUMENTS

| | | | | | |
|---|---|---|---|---|---|
| 3,795,934 | A | * | 3/1974 | Moss | A47L 13/20 15/118 |
| 3,924,289 | A | * | 12/1975 | Richards | A47L 13/20 15/209.1 |
| 5,615,442 | A | | 4/1997 | Schroeck et al. | |
| 5,970,567 | A | * | 10/1999 | Hirse | A47L 13/24 15/147.1 |
| 2012/0056466 | A1 | | 3/2012 | Williams et al. | |

FOREIGN PATENT DOCUMENTS

| | | | |
|---|---|---|---|
| DE | 19614380 | * | 10/1997 |
| EP | 0864292 | A2 | 9/1998 |
| FR | 1247167 | * | 11/1960 |
| JP | 8-10206 | * | 1/1996 |
| JP | 2008-48959 | * | 3/2008 |
| WO | 2006/012926 | * | 2/2006 |

OTHER PUBLICATIONS

Machine translation of DE 1961380, Oct. 16, 1997.*

European Search Report for EP Application No. 15002998.1, mailed Mar. 17, 2016 (6 pages).

* cited by examiner

*Primary Examiner* — Mark Spisich

(74) *Attorney, Agent, or Firm* — Eversheds Sutherland (US) LLP

(57) ABSTRACT

A mop has a plurality of strands secured to a head band. The head band comprises a closed loop formed in a first portion having a first width. A second portion of the head band has a second width where the second width is larger than the first width. The second portion is configured to enclose the distal end of a mop frame when the mop is mounted on the mop frame using the closed loop.

16 Claims, 6 Drawing Sheets

TUBULAR HEAD BAND MOUNTED WET MOP

This application claims benefit of priority under 35 U.S.C. §119(e) to the filing date of U.S. Provisional Application No. 62/065,975, as filed on Oct. 20, 2014, which is incorporated herein by reference in its entirety.

BACKGROUND

The invention relates to mops and more particularly to wet mops such as the type of mop having a plurality of strands of material composed of material such as such as cotton, microfiber, polyester, rayon, nylon, synthetics, blends of such materials or other materials. The strands of material typically extend from a head band where the head band may be releasably supported on a mop handle frame. The mop may be manipulated such that the mop strands contact and spread over a floor or other surface being cleaned and are pushed and/or pulled to clean the floor or other surface.

SUMMARY OF THE INVENTION

In some embodiments, a mop comprises a plurality of strands secured to a head band. The head band comprises a closed loop and a first portion of a first width and a second portion of a second width where the second width is larger than the first width.

The plurality of strands may be attached to the second portion. The loop may be formed in the first portion. A single piece of material may be folded over itself to form the loop. The loop may be configured to receive a clamping arm of a mop handle frame. The second portion may be configured to receive a distal end of a mop handle frame. The head band may comprise a front side wall and a back side wall that extend from a top end of the head band to form the loop. A first lateral side edge and a second lateral side edge may extend from a bottom end of the head band to define the second portion, the front side wall and the back side wall being attached to one another for a length of the first lateral side edge and the second lateral side edge. The second portion may extend between the first lateral side edge and the second lateral side edge.

In some embodiments, a mop and mop handle frame comprise a mop handle frame having a clamping arm and a first support member extending from one end of the clamping arm and a second support member extending from a second end of the clamping arm. A mop comprises a plurality of strands secured to a head band. The head band comprises a closed loop that receives the clamping arm, and a portion that receives and surrounds the clamping arm, a first portion of the first support member and a second portion of the second support member.

The head band may comprise a front side wall and a back side wall that extend from a top end of the head band to form the loop. A first lateral side edge and a second lateral side edge may extend from a bottom end of the head band to define the portion where the front side wall and the back side wall are attached to one another for a length of the first lateral side edge and the second lateral side edge. The loop may have a first width and the portion may have a second width where the second width is larger than the first width. The plurality of strands may be mounted to the portion.

DETAILED DESCRIPTION OF EMBODIMENTS OF THE INVENTION

Figure 1:
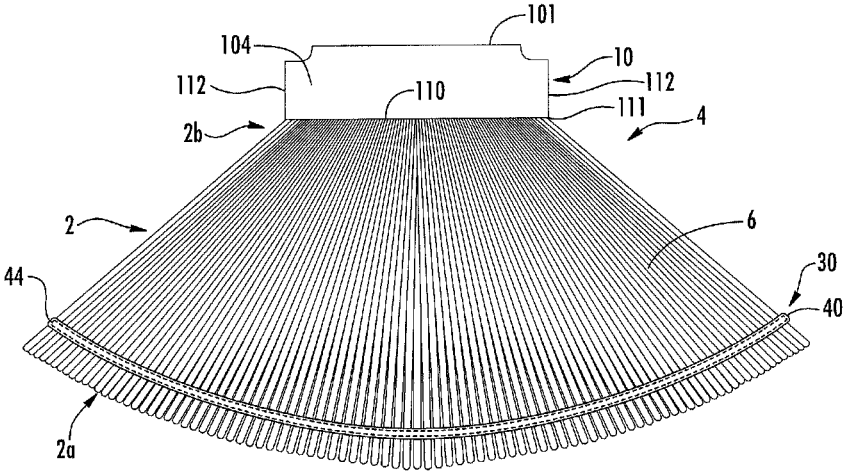
FIG. 1 is a plan view of an embodiment of a mop of the invention.
Figure 2:
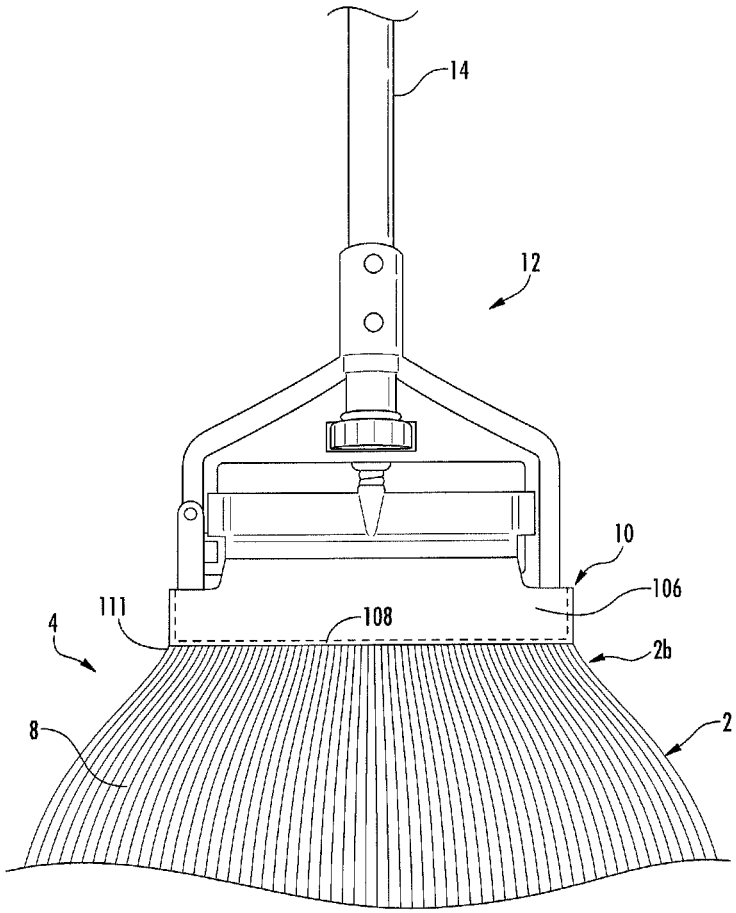
FIG. 2 is a plan view of the opposite side of the mop of FIG. 1 mounted on a mop handle frame.

Referring for example to FIGS. 1 and 2 the mop 4 of the invention comprises a plurality of strands 2 that form a two-sided mop where both the top side 6 and the bottom side 8 of the mop may be used as cleaning surfaces. The strands 2 are typically formed as elongated loops or cut strands made of relatively flexible, water absorbent material. Any suitable material may be used to form the strands 2. The material of the strands may be composed of a variety of structures and/or materials including, but not limited to, yarns, woven or non-woven textiles, felted materials, extruded materials, microfibers and/or other structures, and/or materials including, but not limited to, cotton, microfiber, polyester, rayon, nylon, synthetics, blends of such materials or other materials. The first, proximate ends 2*b* of the strands 2 are gathered in and secured to a head band 10. The head band 10 may comprise a relatively non-absorbent fabric material made of, for example, a PVC coated mesh, or other similar material. The strands 2 typically extend from the head band 10 where the head band 10 may be releasably supported on a mop handle frame 12 such that motion may be imparted to the mop 4 by the elongated mop handle 14 such that the second, distal ends 2*a* of the strands 2 spread over the floor or other surface being cleaned.

The proximal ends 2*b* of strands 2 are gathered in the head band 10 where the distal ends 2*a* of the strands spread to a width that is significantly wider than the width of the head band 10. The greater the spread of the distal ends 2*a* of the strands of the mop, the larger the area of the floor or other surface that may be covered by the mop during each mop stroke. Thus, maintaining the spread of the strands during use of the mop improves the efficacy of the mop during use. A tail band structure 30 may be provided between the head band 10 and the distal ends 2*a* of the strands 2 typically nearer to the free, distal ends 2*a* to secure the strands 2 together to maintain the spread of the strands during use. The tail band structure 30 may comprise at least one strip of material 40 such as an extruded, felted or woven textile or fabric. The strip of fabric is positioned generally transversely to the longitudinal axis of the strands 2 and is connected to the strands, such as by stitching 44.

Figure 3:
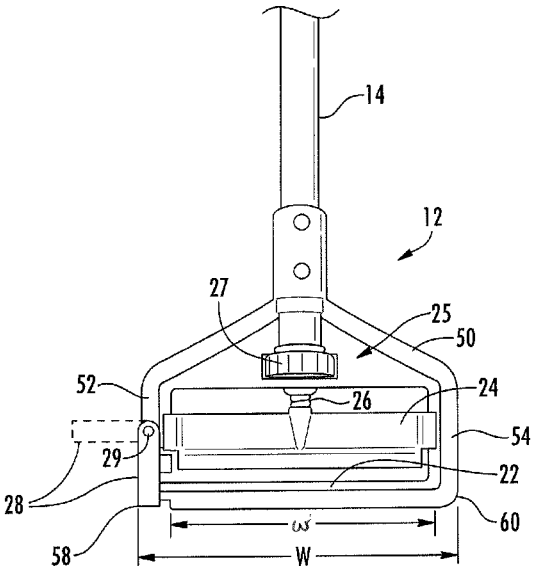
FIGS. 3 and 4 are exemplary embodiments of mop handle frames on which the mop of the invention may be used.
Figure 4:
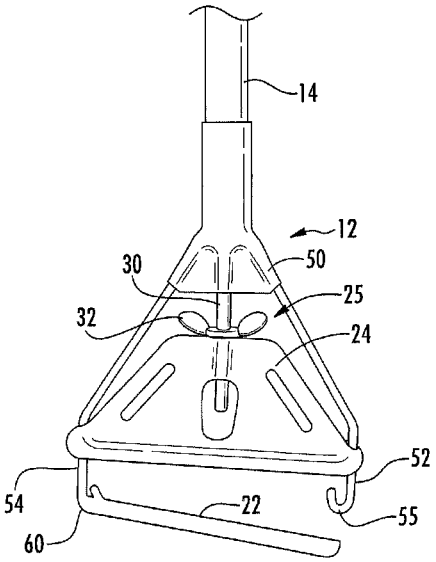
Figure 5:
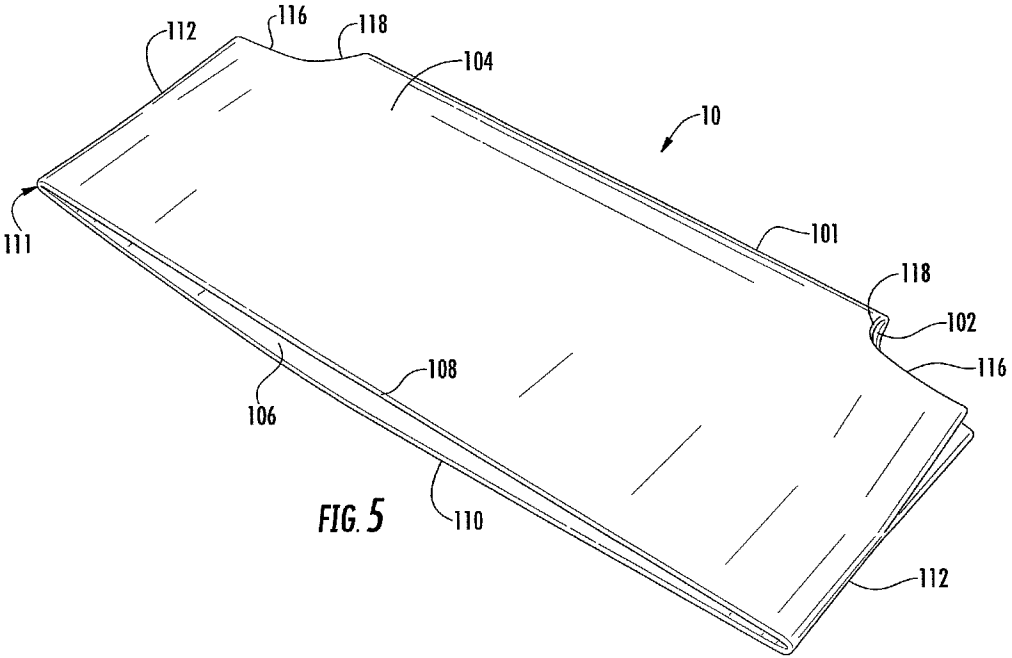
FIG. 5 is a perspective view of an embodiment of a head band used in the mop of the invention.
Figure 6:
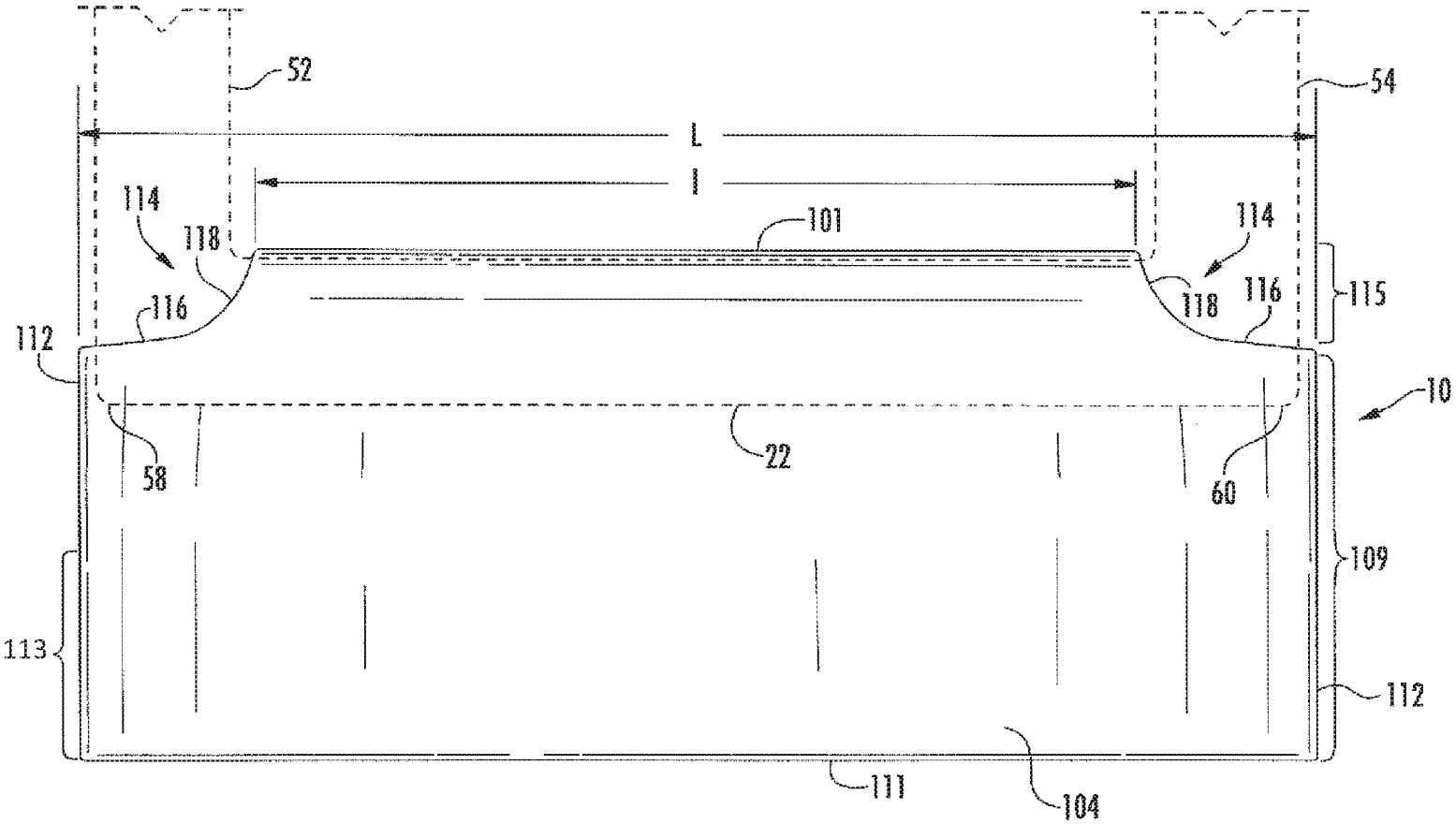
FIG. 6 is a front view of the head band of FIG. 5 mounted on a mop handle frame.
Figure 7:
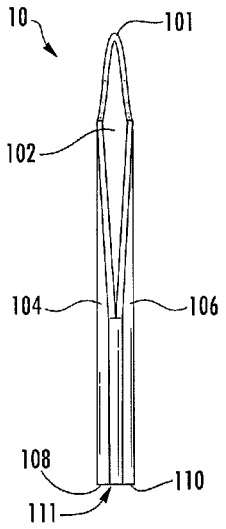
FIG. 7 is a side view of the head band of FIG. 5.

Referring to FIGS. 3 and 4 different embodiments of a mop handle frame 12 are shown where like reference numerals are used to indicate similar components in each of the embodiments. The mop handle frame 12 comprises a clamping arm 22 or other similar structure that is inserted into the closed loop 102 of head band 10 to secure the mop 4 to the mop handle frame 12. The mop handle frame 12 may comprise a locking mechanism, such as a movable jaw 24, to lock the mop 4 to the clamping arm 22. The jaw 24 may be moved towards and away from the clamping arm 22 by a jaw actuator 25. In the embodiment of FIG. 3 the jaw actuator 25 comprises a movable screw 26 that is connected to jaw 24. The screw 26 may be moved linearly by a mating threaded control member 27 that is rotatably supported in support 50 to move the jaw 24 toward and away from the clamping arm 22. In the embodiment of FIG. 4 the jaw actuator 25 comprises a stationary screw 30 that is mounted on support 50 such that a mating nut 32 may be rotated and moved along the length of the screw to move the jaw 24 towards the clamping arm 22. Movement of the nut away from the clamping arm 22 releases the mop 4. The movable jaw 24 is tightened against the head band 10 to clamp the head band in position between the movable jaw 24 and the clamping arm 22. Embodiments of a mop and mop handle frame are shown and described in U.S. Pat. No. 8,585,154, titled "Tubular Headband Mounted Wet Mop", issued to Williams et al. on Nov. 19, 2013 which is incorporated by reference herein in its entirety; U.S. patent application Ser. No. 13/850,983, titled "Tubular Headband Mounted Wet Mop", filed Mar. 26, 2013 which is incorporated by reference herein in its entirety; and U.S. patent application Ser. No. 14/053,424, titled "Tubular Headband Mounted Wet Mop", filed Oct. 14, 2013 which is incorporated by reference herein in its entirety.

The support 50 may be releasably or fixedly attached to the elongated handle 14. The support 50 comprises a pair of generally parallel support members 52 and 54 that define tracks for slidably supporting the movable clamping jaw 24. Extending from the end of one of the support members 54 is the clamping arm 22 that is inserted into the closed loop of the mop 4. A space is created in the other support member 52 that is large enough for the clamping arm to be inserted into the closed loop of the head band 10 and the head band to be slid over the arm 22. In the embodiment of FIG. 3 the support member 52 comprises a retaining member 28 that may be used to close the space. The retaining member 28 may rotate about pivot 29 between the closed solid line position and the open dashed line position. The mop head may be inserted over the clamping arm 22 when the retaining member 28 is in the open position. The retaining member 28 is then rotated to the closed position to complete the engagement of the support member 52 with the end of clamping arm 22. In this embodiment the retaining member 28 may be considered to be a part of support member 52 where the retaining member forms part of the supporting structure between one end of the clamping arm and the mop handle frame. In the embodiment of FIG. 4 the frame 12 is flexed to bring the clamping arm 22 into engagement with the end of support member 52 such that hook 55 may engage a hole formed on clamping arm 22. The support members 52 and 54 and the clamping arm 22 define a generally rectangular support structure for supporting the head band 10 of the mop 4 where the clamping arm 22 joins support members 52 and 54 at corners 58 and 60. As shown in FIGS. 3 and 4 different arrangements, materials and configurations of the mop handle frame 12 may be used with the mop of the invention.

The strands 2 are supported in the head band 10 where the head band 10 or the head band 10 and the proximal ends **2*b* of the strands 2 overlap themselves to create a closed, generally tubular loop or cavity 102 in the head band 10 for receiving the clamping arm 22. A filler material, in addition to the proximal ends 2*b* of the strands 2, may also be provided inside of the head band 10 to support the head band over its length and width. Referring to FIG. 3 in conventional mops the head band is a generally rectangular member that has a width w selected to be approximately the same as the internal distance between the support members 52 and 54 such that the head band and the proximal ends of the strands have a width that is narrower than the width W of the frame between the outside of the support members 52 and 54. As a result, the distal ends of the support members 52 and 54, the ends of clamping arm 22 and the corners 58 and 60 between the clamping arm 22 and the support members 52 and 54 are exposed during use of the mop. The inventors of the present mop have discovered that these exposed areas of frame 12 may adversely affect use of the mop. In some uses of the mop, the exposed corners of the frame may contact the floor or other surface being cleaned. The contact of the distal end of the mop handle frame 12 with the floor is undesirable because it may scratch or mar the surface and makes movement of the mop strands 2** over the floor more difficult.

To avoid these problems the head band 10 of the invention has been developed. In describing the head band of the invention, relative terms such as "below" and "above" or "upper" and "lower" or "horizontal" and "vertical" or "top" and "bottom" or "front" and "back" may be used herein to describe a relationship of one element, layer or region to another element, layer or region as illustrated in the figures. It will be understood that these terms are intended to describe the relative relationship between the elements as illustrated and that the mop may encompass different orientations during use or otherwise in addition to the orientation depicted in, and described with reference to, the figures.

Referring to FIGS. 1, 2 and 5-7, the head band 10 may be formed by folding the material of the head band over itself such that the folded head band forms a closed loop 102 at the top end 101 thereof that creates an internal passage for receiving the clamping arm 22. While in one embodiment a single piece of material is folded over itself to create the loop 102, the head band may be made of more than one piece secured together to create the loop. The head band comprises a front side wall 104 and a back side wall 106 that extend from the top end 101 of the head band. The front side wall 104 and the back side wall 106 terminate in spaced bottom edges 108, 110, respectively, that define the bottom end 111 of the head band 10. The bottom end 111 is disposed at the opposite end of the head band from the loop 102. The front side wall 104 and back side wall 106 receive the proximal ends **2*b* of the strands 2 therebetween such that the strands extend from the bottom end 111 of the head band. The side walls 104 and 106 of the head band 10 are secured to the proximal ends 2*b* of the strands and/or to one another such that the strands 2 are trapped between the side walls 104 and 106 and are attached to the head band 10. The head band 10 may be sewn or otherwise secured to the strands 2**.

The lateral side edges 112 of the head band 10 extend from the bottom end 111 of the head band substantially perpendicularly thereto to define a first wider bottom portion 109 of the head band having a width L. The lateral side edges of the front side wall 104 and the back side wall 106 may be joined together, such as by stitching, between the bottom end 111 of the head band and the bottom end of the loop 102. The lateral side edges of the front side wall 104 and the back side wall 106 are connected together for a first length 113 from the bottom end 111 such that the side edges 112 of the first portion 109 of the head band form a part of the open loop 102 extend.

The top end 101 of the head band that forms the loop 102, has a width 1 that is smaller than the width L of the bottom end 111 of the head band. In one embodiment the top end 101 of the head band 10 has a width 1 that is approximately the same as, slightly larger than or slightly smaller than the width w between the support members 52 and 54 provided that the top end 101 of the head band may fit between the support members 52 and 54. Because the head band 10 may be made of somewhat flexible material it is possible that the head band may be slightly wider than the width w provided that the head band may be slightly compressed between the support members 52 and 54. The bottom end 111 of the head band 10 has a width L that is approximately the same size as or slightly greater than the width W that corresponds to the external width of the distal end of the mop handle frame. With this construction, the top end 101 of the head band 10 fits over the clamping bar 22 between the support members 52 and 54 while the distal end of the mop handle frame 12 fits into the wider bottom portion 109 of the head band 10 such that the distal end of the mop handle frame is not exposed in the area where the mop 4 contacts the floor. This arrangement also allows the proximal ends 2*b* of the strands 2 to be slightly wider than with a conventional head band such that the mop strands may cover more surface area of the surface being cleaned.

Between the top ends of the lateral side edges 112 and the top end 101 of the head band 10 a pair of transition areas 114 are formed where the width of the head band narrows from the relatively wider width L of the bottom portion 109 to the relatively narrower width 1 of the top end 101. Each of the transition areas 114 comprise a first edge 116 that extends substantially inwardly from the lateral edges 112 of the head band and a second edge 118 that extends between the first edge 116 and the top end 101 of the head band to define a second narrower top portion 115 of the head band having a width 1.

Considering the head band 10 in three dimensions an interior space is created that extends between the top end 101 and bottom end 111 that extends for substantially the width of the head band. The interior space comprises a first bottom internal space or pocket in the bottom portion 109 that has a width L that is defined by the front side 104, back side 106, bottom end 111, and lateral side edges 112. This interior space of the wider portion 109 retains and encloses the full length of the clamping arm 22, the ends of the support members 52 and 54 adjacent to the clamping arm 22 and the corners 58 and 60 formed between these members. The interior space comprises a second top internal space or pocket in the top portion 115 that has a width 1 that is defined by the top end 101, front side 104, back side 106, and transition areas 114. The second space is configured to retain the clamping arm 22 when the clamping arm 22 is inserted into loop 102 and the top end 101 of the head band 10 extends over the clamping arm 22. The second space partially encloses the length of the clamping arm 22 between the support members 52 and 54. The top internal space and the bottom internal space together form the internal space of the head band. When the head band is mounted on the mop handle frame 12, the clamping arm 22 may be positioned in both the internal space of top portion 115 and the internal space of bottom portion 109. The internal space of bottom portion 109 surrounds a portion of the clamping arm 22 and the distal ends of support members 52 and 54 and the corners 58 and 60. The bottom portion 109 creates an envelope that receives and surrounds the distal end of the mop handle frame 12 including the distal portions of support members 52 and 54, the corners 58 and 60 and a portion of the clamping bar 22 such that these members are located internally of the head band during use of the mop.

Various embodiments of the invention have been described and illustrated. However, the description and illustrations are by way of example only. Other embodiments and implementations are possible within the scope of the invention and will be apparent to those of ordinary skill in the art. Therefore, the invention is not limited to the specific details of the representative embodiments, and illustrated examples in this description. Accordingly, the invention is not to be restricted except as necessitated by the accompanying claims and their equivalents.

The invention claimed is:

1. A mop comprising:

a plurality of strands secured to a head band, the head band comprising a closed loop and a first portion of a first width and a second portion of a second width where the second width is larger than the first width, wherein the head band comprises a front side wall and a back side wall that extend from a top end of the head band to form the loop, and wherein a first lateral side edge and a second lateral side edge extend from a bottom end of the head band to define the second portion, the front side wall and the back side wall being attached to one another for a length of the first lateral side edge and the second lateral side edge.

2. The mop of claim 1 wherein the plurality of strands are attached to the second portion.

3. The mop of claim 1 wherein the loop is formed in the first portion.

4. The mop of claim 1 wherein a single piece of material is folded over itself to form the loop.

5. The mop of claim 1 wherein the loop is configured to receive a clamping arm of a mop handle frame.

6. The mop of claim 1 wherein the second portion is configured to receive a distal end of a mop handle frame.

7. The mop of claim 1 wherein the second portion extends between the first lateral side edge and the second lateral side edge.

8. A mop and mop handle frame comprising:

a mop handle frame comprising a clamping arm having a first end and a second end and a first support member extending from the first end and a second support member extending from the second end; and a mop comprising a plurality of strands secured to a head band, the head band comprising a closed loop that receives the clamping arm, and a portion that receives and surrounds the clamping arm, a first portion of the first support member and a second portion of the second support member, wherein the head band comprises a front side wall and a back side wall that extend from a top end of the head band to form the loop, and wherein a first lateral side edge and a second lateral side edge extend from a bottom end of the head band to define the portion, the front side wall and the back side wall being attached to one another for a length of the first lateral side edge and the second lateral side edge, the portion extending between the first lateral side edge and the second lateral side edge.

9. The mop of claim 8 wherein the loop has a first width and the portion has a second width where the second width is larger than the first width.

10. The mop of claim 8 wherein the plurality of strands are mounted to the portion.

11. The mop of claim 8 wherein a single piece of material is folded over itself to form the loop.

12. A mop comprising:

a head band comprising a closed loop of a first width and a portion defining an internal space of a second width where the second width is wider than the first width; and a plurality of strands extending from the portion, wherein the head band comprises a front side wall and a back side wall that extend from a top end of the head band to form the loop, and wherein a first lateral side edge and a second lateral side edge extend from a bottom end of the head band to define the portion, the front side wall and the back side wall being attached to one another for a length of the first lateral side edge and the second lateral side edge, the portion extending between the first lateral side edge and the second lateral side edge.

13. The mop of claim 12 wherein the plurality of strands are attached to the portion by stitching.

14. The mop of claim 12 wherein a single piece of material is folded over itself to form the loop.

15. The mop of claim 12 wherein the loop is configured to receive a clamping arm of a mop handle frame.

16. The mop of claim 12 wherein the internal space is configured to receive a lower end of a mop handle frame.

* * * * *